US007220174B2

(12) United States Patent
Phillips et al.

(10) Patent No.: US 7,220,174 B2
(45) Date of Patent: May 22, 2007

(54) DRYWALL SANDER

(75) Inventors: Alan Phillips, Jackson, TN (US); John W. Schnell, Anderson, SC (US); Daniel Paxton Wall, Humboldt, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/238,102

(22) Filed: Sep. 28, 2005

(65) Prior Publication Data

US 2006/0073778 A1 Apr. 6, 2006

Related U.S. Application Data

(60) Provisional application No. 60/643,058, filed on Jan. 11, 2005, provisional application No. 60/614,189, filed on Sep. 29, 2004.

(51) Int. Cl.
*B24B 23/02* (2006.01)
*B24B 23/04* (2006.01)

(52) U.S. Cl. ..... 451/354; 451/356; 451/357; 451/359; 451/557

(58) Field of Classification Search ..... 451/344, 451/351, 352, 353, 354, 356, 357, 358, 359, 451/557, 558
See application file for complete search history.

(56) References Cited

U.S. PATENT DOCUMENTS 3,715,805 A * 2/1973 Fraser ..... 30/166.3
4,654,971 A * 4/1987 Fettes et al. ..... 30/383
4,782,632 A * 11/1988 Matechuk ..... 451/354
4,845,898 A * 7/1989 Preis ..... 451/164
5,013,282 A * 5/1991 Keller ..... 464/172
5,239,783 A * 8/1993 Matechuk ..... 451/354
5,464,367 A * 11/1995 Zink, Jr. ..... 451/441
5,545,080 A 8/1996 Clowers et al. ..... 451/359
5,690,545 A 11/1997 Clowers et al. ..... 451/359
5,926,961 A * 7/1999 Uhl ..... 30/296.1
6,739,059 B2 * 5/2004 Bollinger et al. ..... 30/277.4

FOREIGN PATENT DOCUMENTS

JP 03104550 * 5/1991

* cited by examiner

*Primary Examiner*—Timothy V. Eley
(74) *Attorney, Agent, or Firm*—Joseph F. Key

(57) ABSTRACT

The present invention provides an adjustable drywall sander capable of imparting more than one type of motion. In an exemplary embodiment, the sander includes a power unit with a motor and a sanding assembly coupled to the power unit. A telescopic support arm assembly is coupled to the sanding assembly and the power unit for supporting the sanding assembly. The telescopic support arm assembly includes a first support arm with a first and a second end and a second support arm with a first and second end. The first end of the first support arm being coupled to the power unit and the second end of the second support arm being coupled to the sanding assembly. A collapsible drive shaft is substantially enclosed by the telescopic support arm assembly. The telescopic support arm assembly and the collapsible drive shaft allow the length of the telescopic assembly to be adjusted.

20 Claims, 9 Drawing Sheets

DRYWALL SANDER

CROSS REFERENCE TO RELATED APPLICATIONS

The present application claims the benefit under 35 U.S.C. § 119(e) of U.S. Provisional Patent Application Ser. No. 60/614,189, entitled "Drywall Sander," filed Sep. 29, 2004 and U.S. Provisional Patent Application Ser. No. 60/643,058, entitled "Drywall Sander with Interchangeable Heads," filed Jan. 11, 2005 both of which are herein incorporated by reference in their entireties.

FIELD OF INVENTION

The present invention generally relates to the field of power tools, and more particularly to a device for sanding drywall.

BACKGROUND OF THE INVENTION

In order for the joints between drywall panels to disappear so that the walls and ceilings are smooth, a compound known as joint compound is employed. First, joint compound is applied over the joints in excess and allowed to dry. Second, the excess compound is removed by a sander. It is the removal of the excess joint compound that is often difficult as well as tedious.

Traditionally, a non-motorized, hand or pole sander was most commonly utilized to remove joint compound. However, use of a non-motorized sander often led to user fatigue and was very time consuming. Thus, the non-motorized, hand or pole sander has generally been replaced with a motorized drywall sander including a rotational sanding pad head.

Although currently available motorized drywall sanders have increased the speed in which the compound may be removed, such sanders are limited. First, the amount of time required to complete a sanding job may be actually increased when using such sanders when compared to a non-motorized sander. For example, while the speed of compound removal is increased with use of a motorized sander the overall time associated with the job may not be shortened because of the large amount of dust generated by the motorized sander, making clean-up more difficult and thus, time consuming.

Currently, two primary solutions have been employed to reduce the clean-up time associated with the sanding of drywall with a motorized sander. One solution confines the generated dust by the placement of plastic sheets over all openings leading to dwelling areas in which drywall work is not occurring. In addition to separating the work area from the other dwelling areas, a box fan may be placed in an open window in order to blow the dust outdoors. Such solution confines the majority of dust to the room in which the sanding is being performed, however, the user will still have significant clean-up in such room. In the alternative, a second solution which reduces the total clean-up significantly is the attachment of a dust collection system to the motorized sander whereby a vacuum draws the sanded drywall dust into a dust collecting vessel as the drywall compound is removed.

Although the utilization of a dust collection system with a motorized sander has greatly reduced the amount of dust and therefore, clean-up required, users of such sanders are currently required to purchase multiple sizes and types of these sanders to accomplish a single job. For instance, a user may need a pole sander to reach the ceiling, but wish to use a hand sander for jobs close to the ground. Further, to accomplish inside corner sanding a sander with a triangular head instead of a circular head may be desired. As a result, the user is forced to purchase multiple sanders or to use a sander which may not result in a completely smooth area because access is limited.

Therefore, it would be desirable to provide a drywall sander system capable of adjustment in length and collecting dust and debris, which system includes differently shaped interchangeable sanding heads to allow for multiple types of areas to be sanded with use of a single tool in an efficient manner.

SUMMARY OF THE INVENTION

In a first aspect of the present invention, a sander including a power unit is disclosed. The power unit includes a motor for supplying rotational torque to the sander. A sanding assembly is operationally coupled to the power unit. A telescopic support arm assembly is coupled to the sanding assembly and the power unit for supporting the sanding assembly. The telescopic support arm assembly includes a first support arm with a first and a second end and a second support arm with a first and second end. The first end of the first support arm may be coupled to the power unit while the second end of the second support arm may be coupled to the sanding assembly. Moreover, a collapsible drive shaft is substantially enclosed by the telescopic support arm assembly. The telescopic support arm assembly and the collapsible drive shaft allow the length of the telescopic assembly to be adjusted.

In a further aspect of the present invention, a sander including a power unit is provided. The power unit includes a motor for supplying rotational torque to the sander. A plurality of sanding heads each capable of being coupled to the power unit are included. The sander includes a sanding head connection assembly for coupling one of the plurality of sanding heads to the power unit. The sanding head connection assembly includes a planetary gear reduction system for imparting more than one type of motion to the sander. The ability of the planetary gear reduction system to impart more than one type of motion to the sander allows such sander to sand multiple types of areas.

In an additional aspect of the present invention, a sander including a power unit is disclosed. The power unit includes a motor for supplying rotational torque to the sander. The sander includes a plurality of sanding heads each capable of being coupled to the power unit. A telescopic support arm assembly is coupled to one of the plurality of sanding heads and the power unit for supporting the sanding head. The telescopic support arm assembly may include a first support arm and a second support arm in which the first and second support arms substantially surround a collapsible drive shaft. Moreover, a sanding head connection assembly is included for coupling one of the plurality of sanding heads to the power unit. The sanding head connection assembly includes a planetary gear reduction system for imparting more than one type of motion to the sander. The sanding head connection assembly also includes a sanding head connection adapter for coupling the sanding head connection assembly to one of the plurality of sanding heads. The sanding head connection adapter allows the sanding head to pivot rotationally in relation to the sanding head connection assembly.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Referring in general to FIGS. 1 through 11, a drywall sander including a telescopic support arm assembly and the capability of receiving variously shaped interchangeable sanding heads and providing different motions is provided. Conventional drywall sanders include a rotational pad head capable of rotating at a single speed (e.g. two thousand revolutions per minute, 2000 rpm). Although such sanding head works well for most areas of a wall, access into corners or edges is often limited. For example, a user might not be able to access the corners or edges of a wall easily, causing such surface to be uneven when compared to the surrounding area. In addition, a user may need to sand a portion of the ceiling as well as an area relatively close to the ground surface. The present invention provides a sander which includes a planetary gear reduction system which allows the sanding assembly to impart different motions (e.g., rotational or orbital). Further, the disclosed sander includes a telescopic support arm assembly, allowing a user to adjust the length of the shaft so that the sander may be used as both a hand sander and a pole sander.

Figure 1:
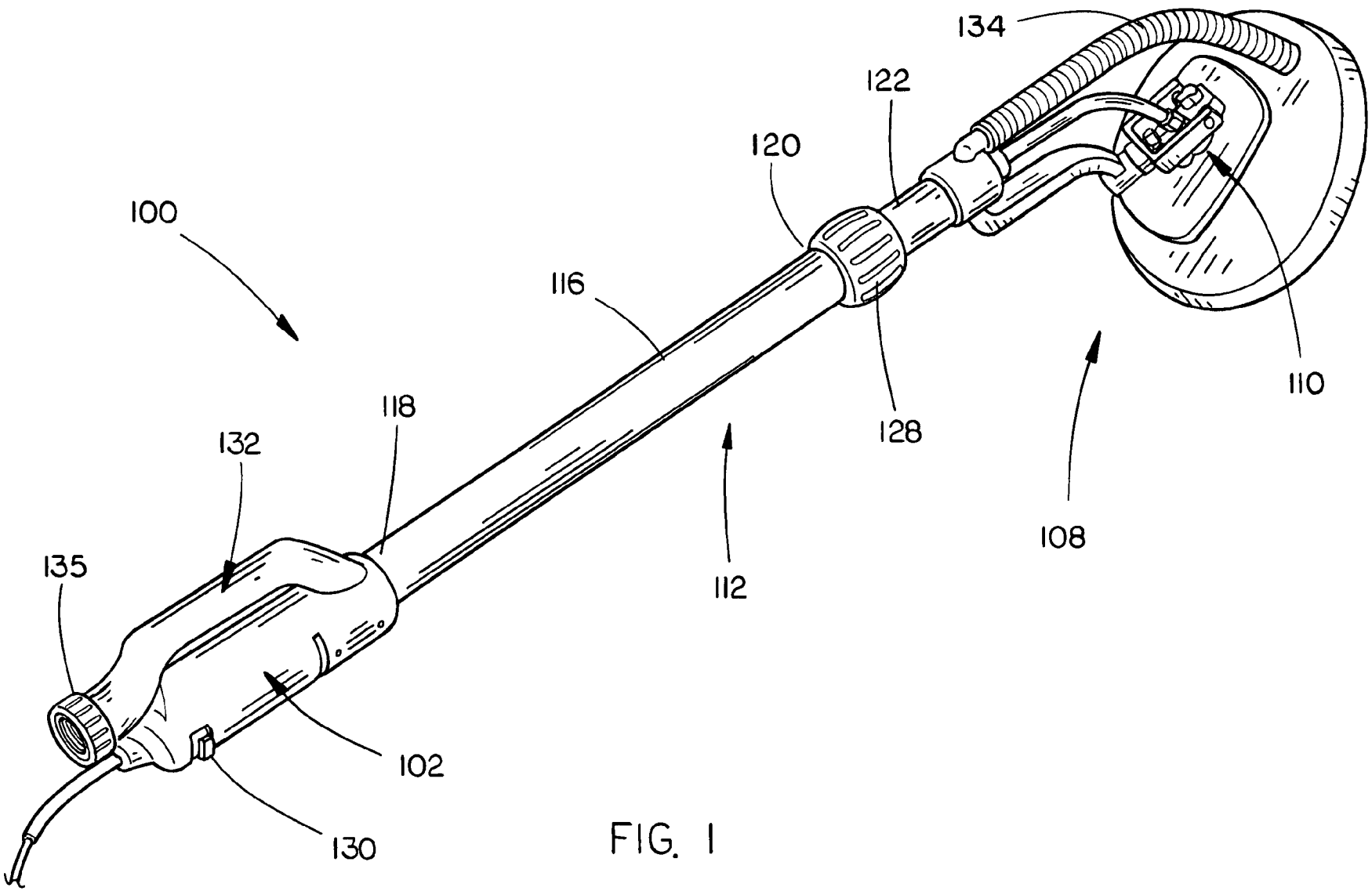
FIG. 1 is an isometric view of a powered drywall sander in accordance with an exemplary embodiment of the present invention, wherein the sander includes a telescopic shaft which allows the length of the sander to be adjusted.
Figure 2:
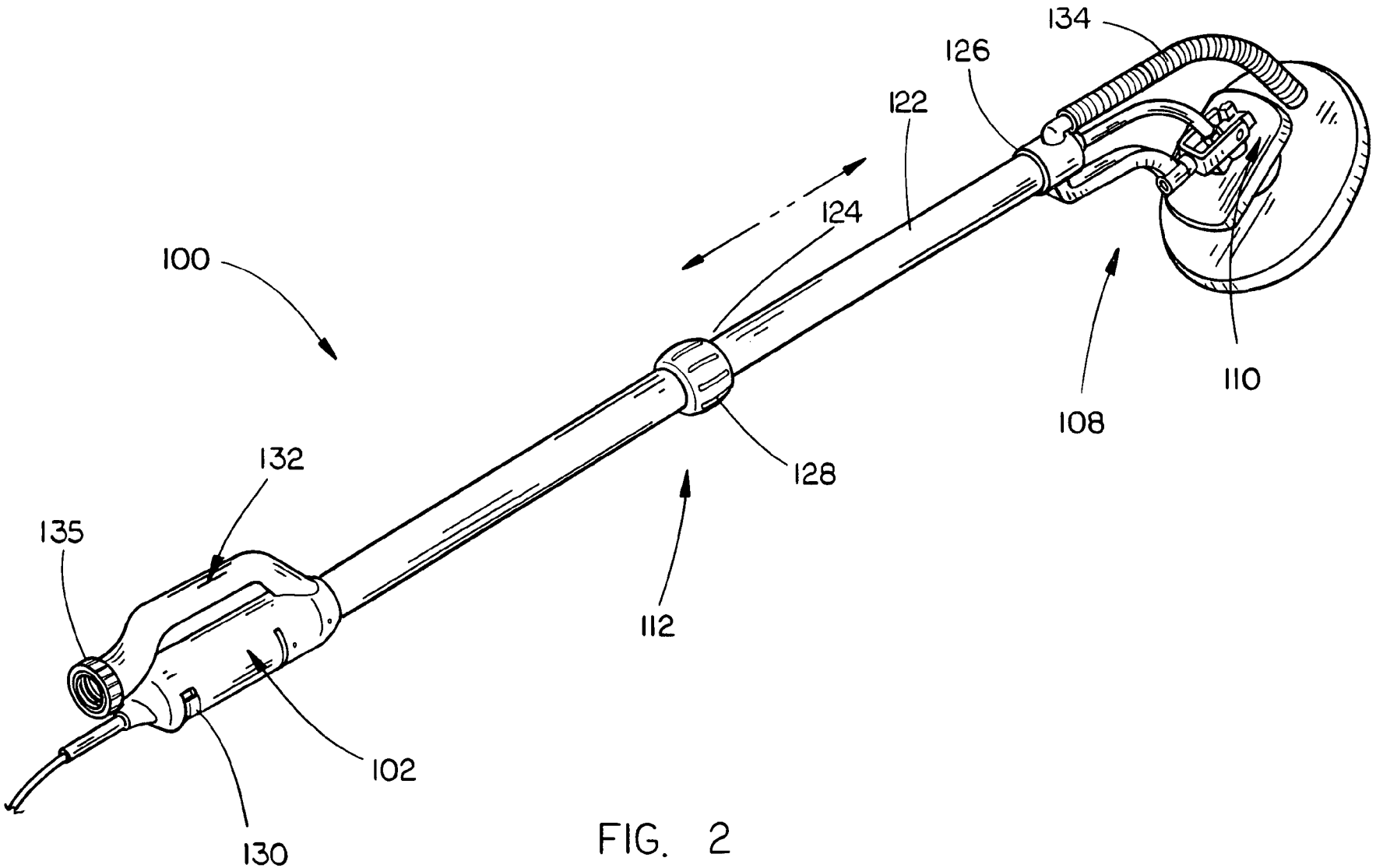
FIG. 2 is an isometric view of the powered drywall sander in accordance with FIG. 1, wherein the telescopic shaft is in an extended position.
Figure 3:
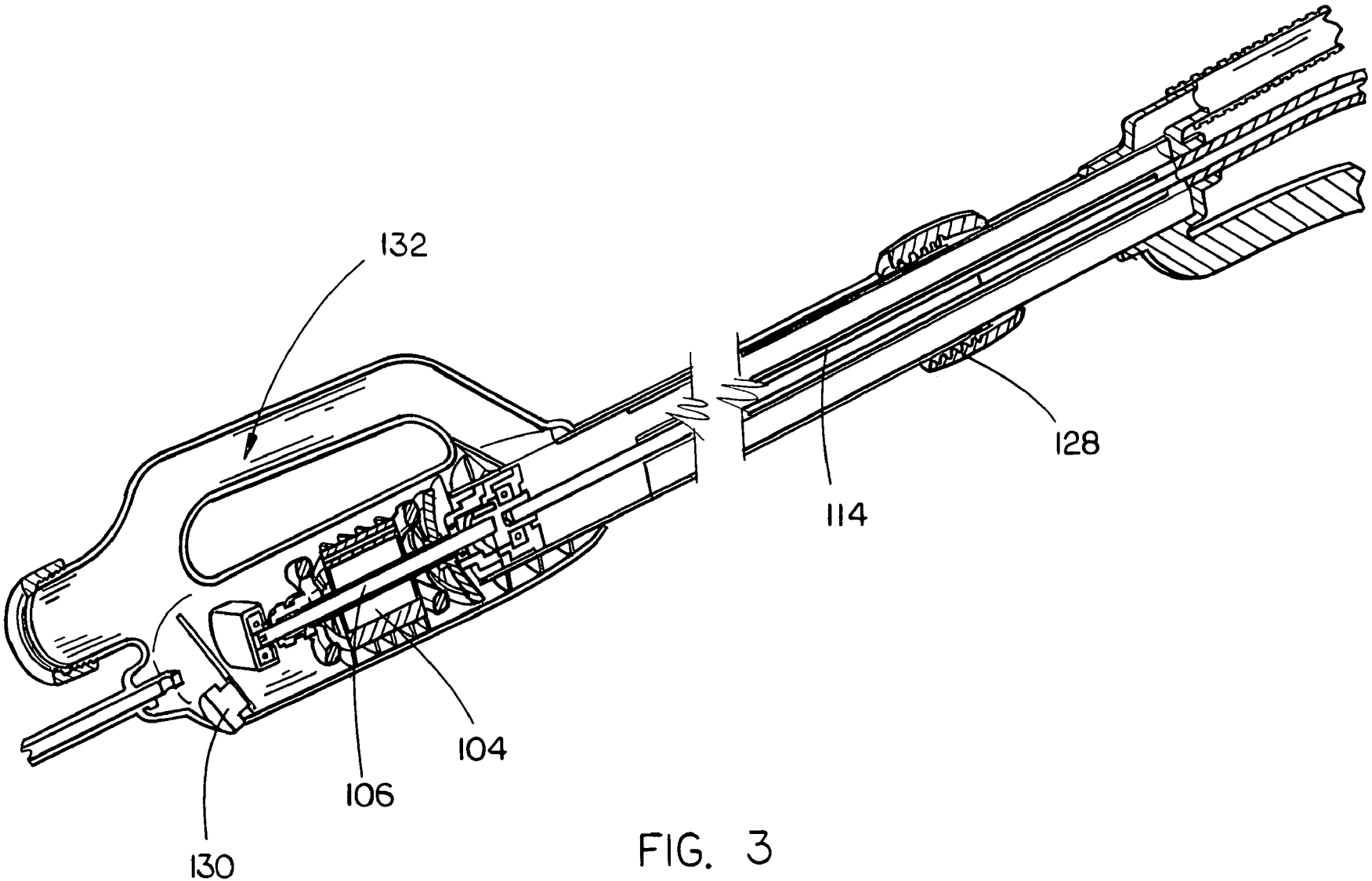
FIG. 3 is a cross-sectional view of a powered drywall sander in accordance with FIG. 1, wherein the powered drywall sander includes a collapsible drive shaft.

Referring specifically to FIGS. 1 through 3, a drywall sander 100 in accordance with an exemplary embodiment of the present invention is provided in which the sander 100 includes a housing 102 for substantially enclosing a drywall sander power unit. In the present embodiment, the drywall sander power unit includes a motor 104 for supplying rotational torque to the drywall sander 100 and a drive shaft for transferring the rotational torque of the motor 104 to a sanding assembly 108. For example, the sanding assembly 108 may be capable of coupling to varying shaped heads, each capable of being operationally coupled to the power unit for removing joint compound. In an exemplary embodiment, a sanding head connection assembly 110 is employed to couple a sanding head to the power unit. It is contemplated that more than one drive shaft may be employed to transfer the rotational torque generated by the motor 104 to a sanding head. For example, a first drive shaft 106 formed of metal or the like may be operationally coupled to the motor 104. In turn, a second drive shaft 114 which is capable of collapsing may be mechanically coupled to the first drive shaft 106. The second drive shaft 114 may be formed of a lightweight material to minimize the weight of the drywall sander and may extend the length of a telescopic support arm assembly 112. In addition, a third drive shaft may be coupled to the second drive shaft 114 and the sanding head connection assembly 110. As illustrated in FIGS. 1 and 2, the shaft which connects the second drive shaft to the sanding head connection assembly 110 may be flexible or irregular in shape.

In the present embodiment, the telescopic support arm assembly 112 is operationally coupled to the sanding assembly 108 and the power unit for supporting the sanding assembly 108 and substantially enclosing the second or collapsible drive shaft 114 extending to the sanding assembly 108. In such embodiment, the telescopic support arm assembly 112 includes a first support arm 116 with a first and a second end 118, 120 and a second support arm 122 with a first and second end 124, 126, the first end 118 of the first support arm 116 is operationally coupled to the power unit and the second end 126 of the second support arm 122 is operationally coupled to the sanding assembly 108. As such, the telescopic support arm assembly 112 with the collapsible drive shaft 114 allows the length of the telescopic assembly to be adjusted according to the worksurface which is to be sanded.

In the exemplary embodiment, as illustrated in FIG. 3, the collapsible drive shaft 114 is held within the telescopic support arm assembly 112 by a collapsible joint 128. For example, the collapsible joint 128 is a threaded locking collar. It is contemplated that additional mechanisms may be used in addition to the collapsible joint 128 without departing from the scope and spirit of the present invention. In use, a user may extend (FIG. 2) or retract (FIG. 1) the telescopic support arm assembly 112 by loosening the collapsible joint 128, extending or retracting the first 116 and second 122 support arms including the collapsible drive shaft 114 to a desired position, and then, locking the drive shaft 114 into place by tightening the collapsible joint 128. For instance, a user may extend the telescopic support arm assembly 112 completely in order to sand a ceiling or completely retract such shaft assembly 112 for use in a small or enclosed area. Therefore, the present invention is advantageous in that it provides the user with both a hand sander and pole sander in one device. Further, the ability of the sander to collapse allows the sander to be stored more easily whereby less space is required when compared to traditional non-adjustable pole sanders. Moreover, shipping costs are also reduced because the retractable sander may be shipped in a smaller box.

In an advantageous embodiment, the telescopic support arm assembly 112 is formed of carbon fiber tubing. Use of carbon fiber tubing allows the sander 100 to be lightweight and thus, possibly decrease user fatigue. However, those of ordinary skill in the art will appreciate that the telescopic assembly 112 may be formed by use of numerous types of materials including plastic, fiberglass, metal, metal alloy, and the like without departing from the scope and spirit of the present invention.

In accordance with an exemplary embodiment of the powered drywall sander 100, a user may control the power supplied by the motor 104 to the sanding assembly 108 via use of a power switch 130. Moreover, in additional embodiments, the powered drywall sander may be equipped with a speed dial (not shown) allowing the speed of the sanding head to be controlled.

It is to be understood by those of ordinary skill in art that any standard universal motor may be employed to power the present drywall sander. In an advantageous embodiment, the motor 104 is located in the lower portion of the drywall sander 100 in order to minimize user fatigue. Further, a handle 132 may be defined within the power unit housing 102 for providing a user grip surface.

In additional exemplary embodiments, the sander 100 includes a built in dust collection system to contain drywall dust as sanding is performed to minimize the amount of clean-up. In the present embodiment, a built in dust collection vacuum hose 134 travels from a sanding head down the telescopic support arm assembly 112. Dust and debris may ultimately be deposited into a dust bag, canister or receptacle. In an advantageous embodiment, the handle 132 defined within the power unit housing 102 includes a dust collection tube which allows dust to pass from the telescopic support arm assembly 112 to the desired dust collecting receptacle. In an alternative embodiment, an adapter 135 may be employed to allow the sander 100 to be connected to various types of wet/dry shop vacuums and vacuum cleaners to allow dust to be contained, thereby minimizing clean-up.

Referring to FIGS. 1 and 4 through 11, the capability of the drywall sander 100 to accommodate varying sized sanding heads and impart more than one type of motion to the sanding system is provided. In an exemplary embodiment, as illustrated in FIG. 1, the drywall sander 100 sanding system 108 includes the sanding head connection assembly 110 for connecting a sanding head to the collapsible drive shaft 114 defined within the telescopic support arm assembly 112, allowing more than one type of motion to be provided by the sander 100.

Figure 4:
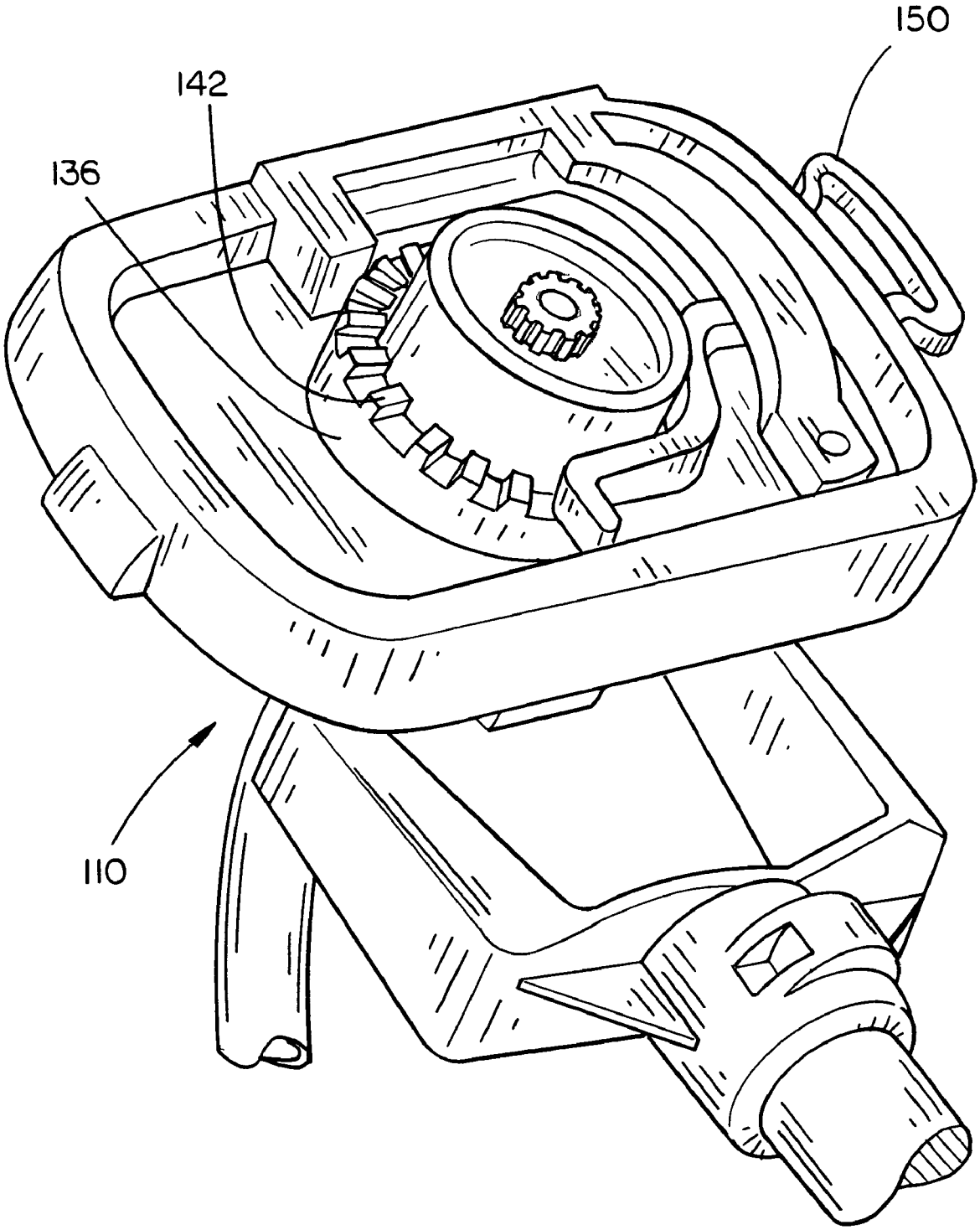
FIG. 4 is a partial isometric bottom view of a sanding head connection assembly in accordance with an exemplary embodiment of the present invention, wherein the sanding head connection assembly includes a sanding head connection adapter.
Figure 6A:
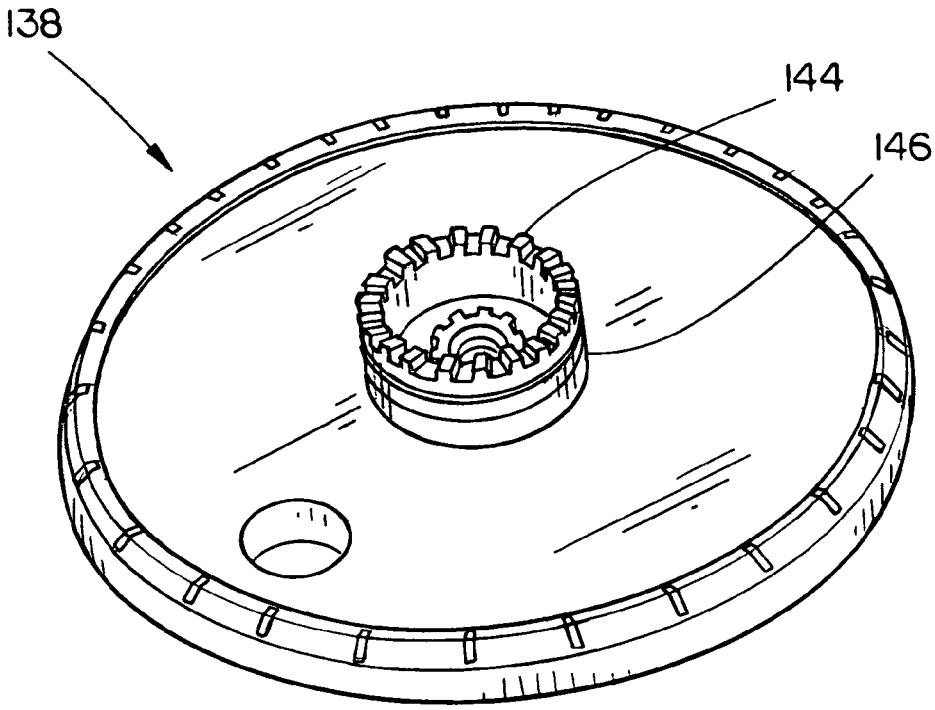
FIG. 6A is an isometric view of a rotational sanding pad head in accordance with an exemplary embodiment of the present invention, wherein the head includes a connector with teeth for connecting the head to a sanding head connection assembly.
Figure 6B:
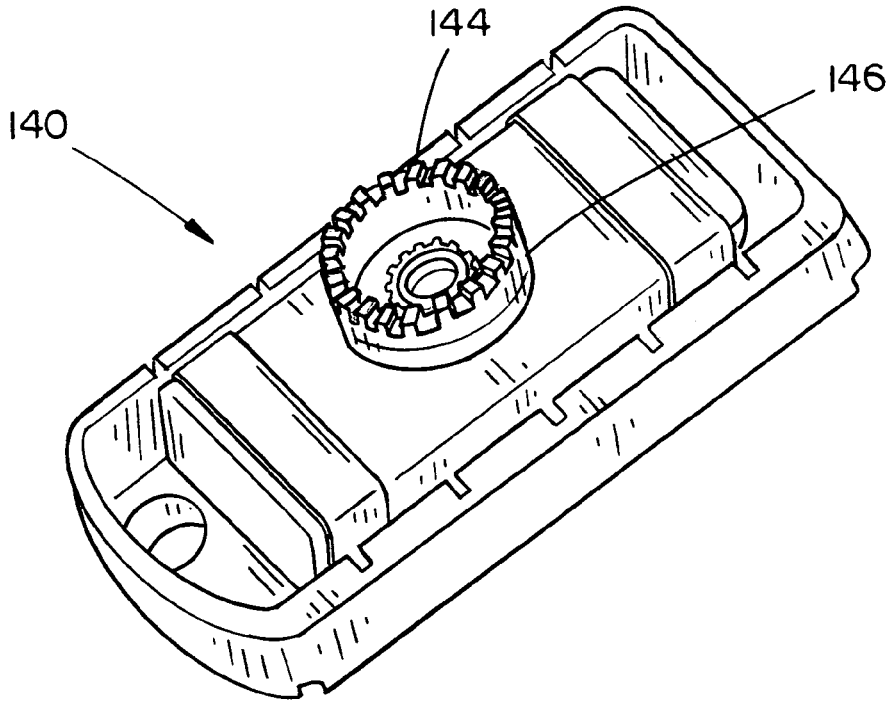
FIG. 6B is an isometric view of a orbital sanding pad head in accordance with an exemplary embodiment of the present invention, wherein the head includes a connector with teeth for connecting the head to a sanding head connection assembly.

Referring to FIG. 4, an exemplary sanding head connection assembly 110 is provided in which such assembly 110 includes a sanding head connection adapter 136 for allowing a sanding head to pivot rotationally in relation to the sanding head connection assembly 110. In an exemplary embodiment, a plurality of teeth 142 are defined within the sanding head connection adapter 136. Such teeth 142 may align with teeth 144 on a sanding head connector 146 allowing the head to be placed in any rotational position relative to the sanding head connection adapter. For example, a circular or rotational sanding pad head 138 in accordance with an exemplary embodiment of the present invention is illustrated in FIG. 6A in which the head 138 includes the connector 146 with teeth 144 for connecting the head 138 to a sanding head connection assembly 110. Alternatively, FIG. 6B illustrates an exemplary rectangular shaped or orbital sanding pad head 140 including a connector 146 with teeth 144. In a preferred embodiment, the outer diameter of the connector on the rotational head is approximately the same size and shape as the outer diameter of the orbital head connector. The presence of the teethed-connector 146 with approximately the same outer diameter size and shape allows the heads to be interchanged with the sanding head connection assembly 110 with little effort. For example, to change from a rotational sanding head to an orbital sanding head, a user simply disconnects the rotational sanding head from the sanding head connection adapter and then, connects the orbital head. Thus, no reconfiguration of the adapter or the sanding head is necessary. In addition, the sanding head connection adapter 136 imparts an additional degree of freedom to the sanding assembly. For example, during use, a sanding head is biased to return to its installed location, but the head is configured to pivot rotationally in relation to the sanding head connection assembly 110 plus or minus approximately forty-five degrees, making it easier for a user to use the sander in the orbital sanding configuration. For instance, it is not necessary for a user to stand directly in-line with the sander when using the sander.

In further exemplary embodiments, the sanding head connection adapter 136 included within the sanding head connection assembly 110 may include a compression spring and at least one lever to provide centering load for such adapter 136. In addition, a lever 150 may be included to assist in securing a sanding head to the sanding head connection assembly 110.

Figure 5A:
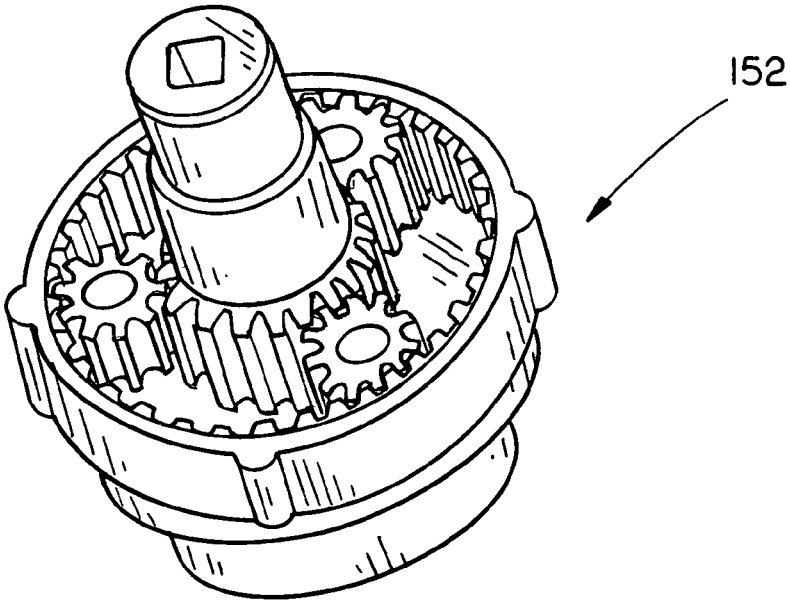
FIG. 5A is an isometric view of a planetary gear reduction system in accordance with an exemplary embodiment of the present invention.
Figure 5B:
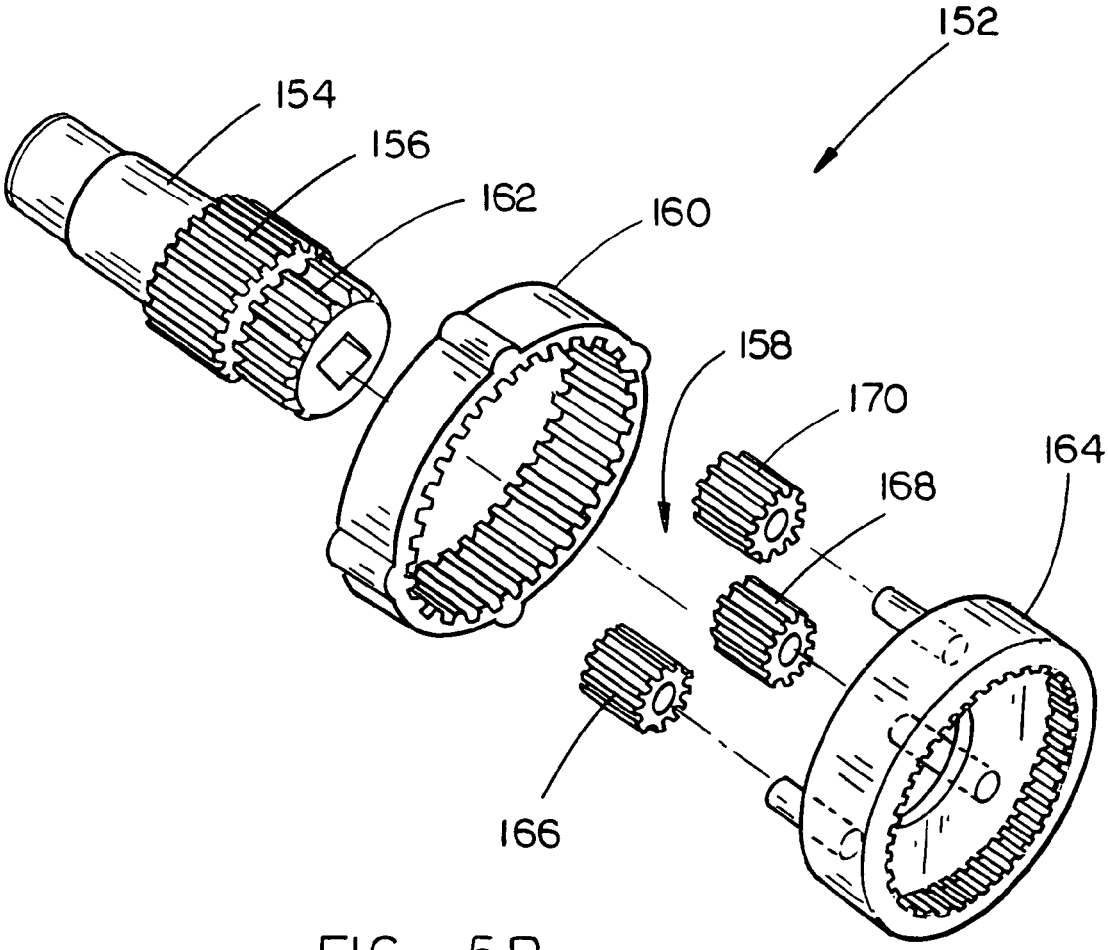
FIG. 5B is an exploded view of the planetary gear reduction system illustrated in FIG. 5A, wherein the planetary gear reduction system includes a shaft with a sun gear and a plurality of planets contained within a ring gear.

In an additional exemplary embodiment, the sanding head connection assembly 110 includes the planetary gear reduction system 152 for imparting more than one type of motion to the sanding system. An exemplary planetary gear reduction system 152 is illustrated in FIGS. 5A and 5B. In the exemplary embodiment, the planetary gear reduction system 152 includes a shaft 154 with a sun gear 156 and a plurality of planets 158 contained within a ring gear 160. Further, the shaft 154 with the sun gear 156 includes a first drive member 162 and a second drive member 164. In such embodiment, the sun gear 156 is surrounded by a first planet 166, a second planet 168, and a third planet 170, each of which is threaded thereby allowing the planets to be coupled with the ring gear 160 and the sun gear 156. It is contemplated that the plurality of planets 152 may be coupled to the ring 160 and the second drive member 164 via pins disposed within the second drive member 164. This arrangement allows the axis of the output gear to be approximately equivalent to that of the input gear. In addition, use of three planets instead of one yields a gear train capable of withstanding a great deal of use and strain. Further, the described configuration provides a planetary gear reduction system capable of imparting both rotational and orbital motion to the sanding head. It is contemplated that additional gear configurations may be employed without departing from the scope and spirit of the present invention.

In use, the present invention forms a two-stage planetary gear system. First, the first drive member 162 including the sun gear 156 is employed to drive a orbital sanding head 140 at a suitable speed (e.g. to spin at 6000 rpm). For example, an orbital sanding pad head may includes an eccentric recess and the first drive member drives a pin which drives the eccentric recess to create orbital motion. Second, the second drive member 164 is driven by the planets to provide the speed necessary to drive a rotational head 138 at a suitable speed (e.g. 2000 rpm). In one embodiment, a three to one ratio of speeds is employed whereby the sun gear 156 turns at 6000 rpm to drive the orbital sanding head 140 and the second drive member 164 turns at 2000 rpm to drive the rotational head 138.

Figure 7:
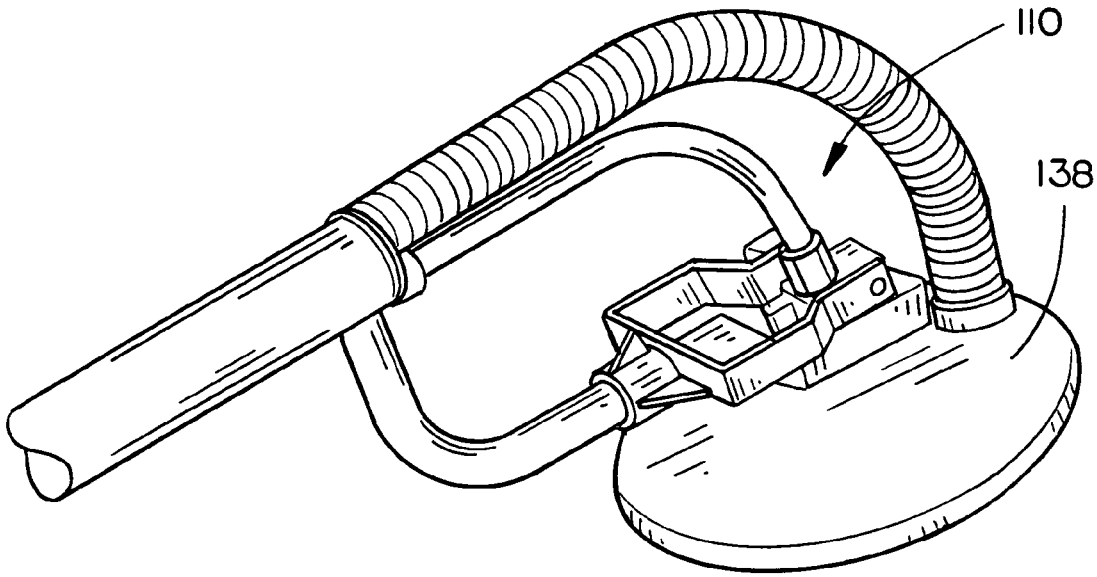
FIG. 7 is a partial isometric view of a powered drywall sander in accordance with an exemplary embodiment of the present invention, wherein a rotational head is connected to the sanding head connection assembly.
Figure 8:
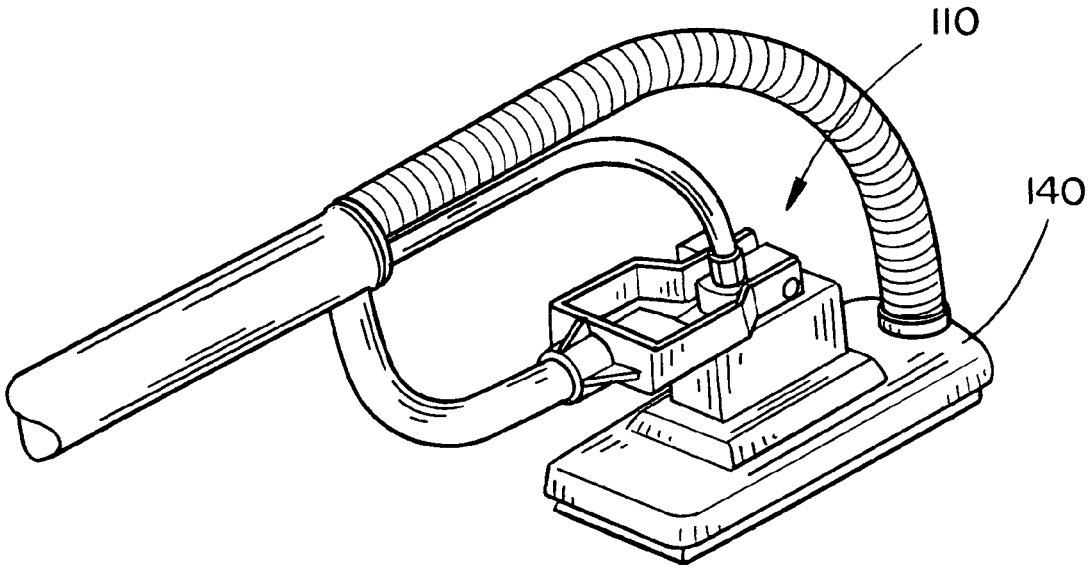
FIG. 8 is a partial isometric view of a powered drywall sander in accordance with an exemplary embodiment of the present invention, wherein an orbital head is connected to the sanding head connection assembly.

As illustrated in FIG. 7, a circular shaped sanding head 138 may be connected to the sanding head connection assembly 110 for rotational sanding. In an alternative embodiment, as illustrated in FIG. 8, a rectangular shaped or orbital sanding head 140 may be connected to the sanding connection assembly 140 for orbital sanding. It is contemplated that additional shapes of heads may be employed including triangular without departing from the scope and spirit of the present invention.

Figure 9:
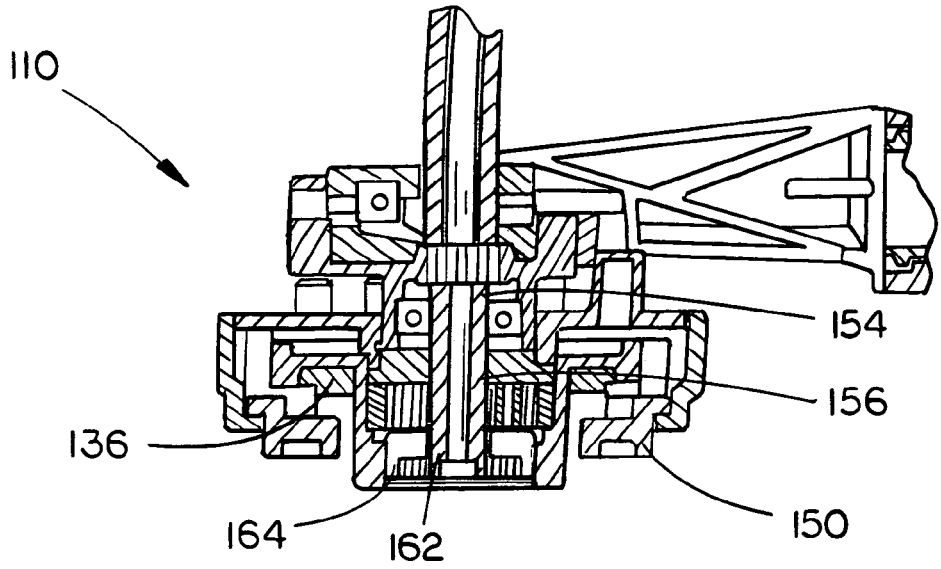
FIG. 9 is a cross-sectional side view of a sanding head connection assembly in accordance with an exemplary embodiment of the present invention, wherein the positioning of the components of the sanding head connection assembly without a sanding head attached is illustrated.
Figure 10:
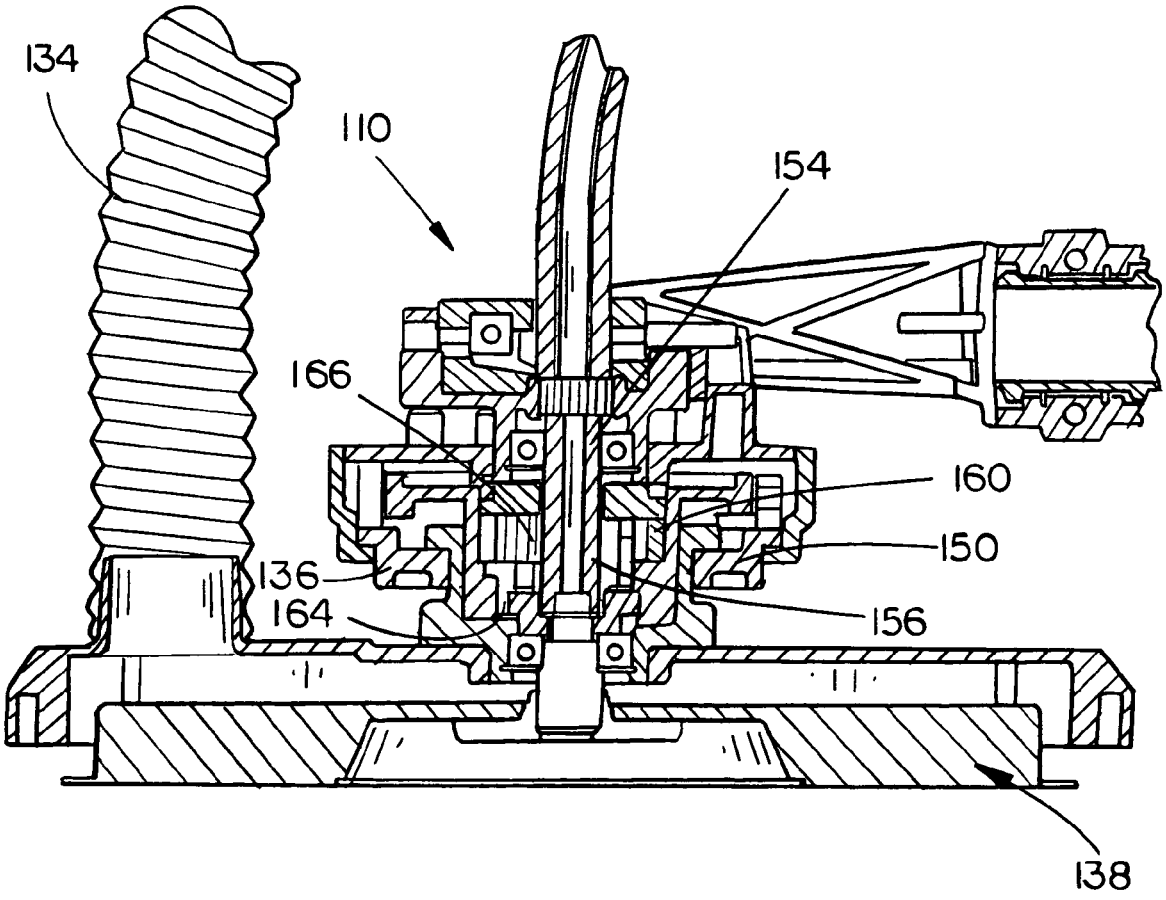
FIG. 10 is a cross-sectional side view of a sanding head connection assembly in accordance with an exemplary embodiment of the present invention, wherein a sanding head is engaged with the assembly.
Figure 11:
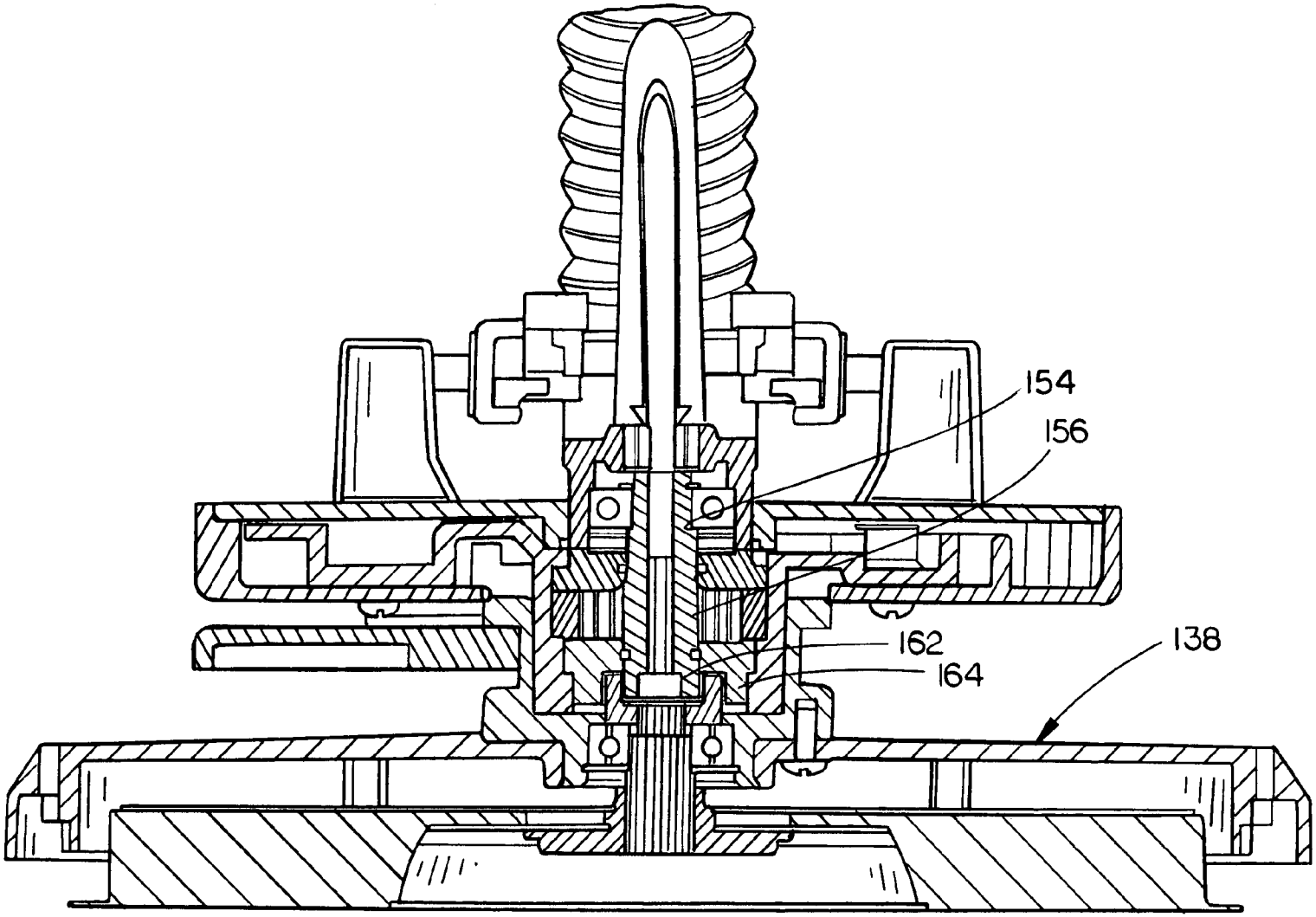
FIG. 11 is a cross-sectional front view of the sanding head connection assembly as illustrated in FIG. 10.

In an exemplary embodiment, the positioning of the sanding head on the sanding head connection assembly 110 is determined by the shape and size of the inner diameter of the connector 146 defined on a sanding head. As described previously, the outer diameter of the connector 146 may be approximately equivalent in shape and size on the various sanding heads, allowing the adapter 136 and the desired sanding head to be connected efficiently. In contrast, the shape and size of the inner diameter of such connector 146 may vary depending upon the type of motion (e.g., rotational or orbital) the sanding assembly 108 is to impart. For example, as illustrated in FIG. 6A, the inner diameter of the connector 146 on the rotational or circular shaped sanding pad 138 is circular and a plurality of teeth travel along the perimeter of the circle. The plurality of teeth assist in positioning the rotational shaped sanding pad 138 with the sanding head connection assembly 110 so that the planetary gear reduction system 152 is capable of imparting rotational motion to the rotational sanding pad head 138. The positioning of the rotational sanding pad head 138 relative to the various components of the sanding head connection assembly 110 is illustrated in FIGS. 9 through 11. FIG. 9 demonstrates a sanding head connection assembly 110 without a sanding head attached. FIGS. 10 and 11 illustrate the sanding head connection assembly 110 with the rotational sanding head 138 connected to the assembly 110. In addition, as illustrated in FIG. 6B, the inner diameter of the connector 146 disposed on the orbital sanding pad head 140 is also circular; however, the perimeter of the circle is smooth and an extension extends up through the center of the circle. Such configuration allows the orbital sanding head 140 to align with the planetary gear reduction system 152 so that the sanding head connection assembly imparts orbital motion to the orbital sanding pad 140.

Although the present disclosure describes a sander for removing drywall, it is contemplated that such sander may be utilized to removed additional types of materials including plaster, concrete, wood, and the like without deviating from the scope and spirit of the present invention.

It is believed that the present invention and many of its attendant advantages will be understood by the foregoing description. It is also believed that it will be apparent that various changes may be made in size, materials, shape, form, function, manner of operation, assembly and use of the components thereof without departing from the scope and spirit of the invention or without sacrificing all of its material advantages. The form herein before described being merely an explanatory embodiment thereof.

What is claimed is:

1. A sander, comprising:

a power unit including a motor;

at least one sanding head, the at least one sanding head being capable of coupling to the power unit; and a sanding head connection assembly for coupling the at least one sanding head to the power unit, the sanding head connection assembly including:

a planetary gear reduction system for imparting more than one type of motion to the at least one sanding head, and a sanding head connection adapter for coupling the sanding head connection assembly to the at least one sanding head for allowing the at least one sanding head to pivot rotationally in relation to the sanding head connection assembly.

2. The sander as claimed in claim 1, further comprising a dust and debris collection assembly for collecting dust and debris from the sanding assembly during operation.

3. The sander as claimed in claim 1, wherein the planetary gear reduction

4. The sander as claimed in claim 1, wherein the planetary gear reduction system includes a shaft with a sun gear and a plurality of planets contained within a ring gear.

5. The sander as claimed in claim 4, wherein the shaft and sun gear include a first drive member and a second drive member, the first drive member and the sun gear are employed to impart orbital motion to the at least one of sanding head, the second drive member is driven by the plurality of planets contained within the ring gear, and the second drive member imparts rotational motion to the at least one sanding head.

6. The sander as claimed in claim 1, wherein the at least one sanding head includes an orbital sanding head and a rotational sanding head.

7. The sander as claimed in claim 6, wherein the sander employs a three-to-one ratio of speed to drive the orbital sanding head and the rotational sanding head, the orbital sanding head is driven at approximately three times the speed of that employed to drive the rotational sanding head.

8. The sander as claimed in claim 1, further comprising a telescopic support arm assembly including a collapsible drive shaft for allowing a sander size to be adjusted.

9. A sander, comprising:

a power unit including a motor;

at least one sanding head, each of the at least one sanding head being capable of coupling to the power unit;

a telescopic support arm assembly coupled to one of the at least one sanding head and the power unit for supporting the one of the at least one sanding head, the telescopic support arm assembly including a first support arm and a second support arm, the first and second support aims substantially surrounding a collapsible drive shaft; and a sanding head connection assembly for coupling one of the at least one sanding head to the power unit, the sanding head connection assembly including:

a planetary gear reduction system for imparting more than one type of motion to the at least one sanding head, and a sanding head connection adapter for coupling the sanding head connection assembly to one of the at least one sanding head, wherein the sanding head connection adapter allows the at least one sanding head to pivot rotationally in relation to the sanding head connection assembly.

10. The sander as claimed in claim 9, wherein the sanding head connection adapter allows one of the at least one sanding head to pivot rotationally in relation to the sanding head connection assembly by plus or minus approximately forty-five degrees.

11. The sander as claimed in claim 9, wherein the sanding head connection assembly includes a biasing mechanism and at least one lever for centering the load force of the sanding head connection assembly.

12. The sander as claimed in claim 9, wherein the biasing mechanism is a compression spring.

13. The sander as claimed in claim 9, wherein the sanding head connection adapter includes a plurality of teeth, and the at least one sanding head includes a connector, the connector including teeth corresponding to those disposed on the adapter allowing the adapter to be individually coupled with one of the at least one sanding head.

14. A sander system, comprising:

a power unit including a motor;

multiple sanding heads, each of the sanding heads being capable of coupling to the power unit; and a sanding head connection assembly for coupling the sanding heads to the power unit, the sanding head connection assembly including:

a planetary gear reduction system for imparting more than one type of motion to the sanding heads, and a sanding head connection adapter for coupling the sanding head connection assembly to the sanding heads for allowing the sanding heads to pivot rotationally in relation to the sanding head connection assembly.

15. The sander system as claimed in claim 14 wherein the planetary gear reduction system imparts both a rotational motion and an orbital motion to the sanding heads.

16. The sander system as claimed in claim 14 wherein the planetary gear reduction system includes a shaft with a sun gear and multiple planets contained within a ring gear.

17. The sander system as claimed in claim 16 wherein the shaft and sun gear include a first drive member and a second drive member, the first drive member and the sun gear are employed to impart orbital motion to a first sanding head, the second drive member is driven by the plurality of planets contained within the ring gear, and the second drive member imparts rotational motion to a second sanding head.

18. The sander system as claimed in claim 14 wherein the sanding heads include an orbital sanding head and a rotational sanding head.

19. The sander system as claimed in claim 18 wherein a three-to-one ratio of speed is employed to drive the orbital sanding head and the rotational sanding head, the orbital sanding head is driven at approximately three times the speed of that employed to drive the rotational sanding head.

20. The sander system as claimed in claim 14 further comprising a telescopic support arm assembly coupled to the power unit and the sanding head connection assembly.

* * * * *